United States Patent [19]

Rackind

[11] Patent Number: 4,870,239

[45] Date of Patent: Sep. 26, 1989

[54] INDUCTION HEATER FOR DRUMS

[76] Inventor: Malcolm I. Rackind, 105 Minchenden Crescent, Southgate, London, N14, 7EP, Great Britain

[21] Appl. No.: 897,535

[22] PCT Filed: Nov. 15, 1985

[86] PCT No.: PCT/GB85/00520

§ 371 Date: Sep. 15, 1986

§ 102(e) Date: Sep. 15, 1986

[87] PCT Pub. No.: WO86/03088

PCT Pub. Date: May 22, 1986

[30] Foreign Application Priority Data

Nov. 15, 1984 [GB] United Kingdom ..... 8428841

[51] Int. Cl.[4] ..... H05B 6/10

[52] U.S. Cl. ..... 219/10.75; 219/10.491; 219/10.57; 116/208

[58] Field of Search ..... 219/10.65, 10.79, 10.75, 219/8.5, 10.77, 10.49, 10.57, 10.491, 10.43; 116/208

[56] References Cited

U.S. PATENT DOCUMENTS

| | | | |
|---|---|---|---|
| 1,885,171 | 11/1932 | Balmer | 116/208 |
| 2,848,566 | 8/1958 | Limpel | 219/10.79 |
| 3,228,735 | 1/1966 | Stewart | 116/208 |
| 3,502,840 | 3/1970 | Khrenov et al. | 219/8.5 |
| 3,678,883 | 7/1972 | Fischer | 116/208 |
| 3,691,339 | 9/1972 | Cachat | 219/10.75 |
| 3,805,010 | 4/1974 | Cuvelier | 219/10.79 |
| 3,827,275 | 8/1974 | Suttan et al. | 219/10.79 |
| 3,860,737 | 1/1975 | Moscatello | 219/10.61 |
| 3,922,999 | 12/1975 | Meginnis | 116/208 |
| 4,247,736 | 1/1981 | Grigoriev et al. | 219/10.79 |

FOREIGN PATENT DOCUMENTS 0839343 6/1960 United Kingdom .

*Primary Examiner*—M. Paschall
*Attorney, Agent, or Firm*—Rosen, Dainow & Jacobs

[57] ABSTRACT

An induction heater (1) includes a substantially cylindrical jacket adapted to be placed around an article which is to be induction heated, an induction coil (5) arranged within the jacket, and protuberances (4) projecting inwardly from the internal surface of the jacket to keep the article spaced apart from the surface so as to avoid abrasion of the surface by the article. The protuberances (4) may be axially extending ribs, and may incorporate a device, such as an embedded layer, to provide a change in the visible color thereof when worn down. A multipart construction is given for the heater, in which the coil (5) is wound onto an inner former (2) and outer shells (6) are located over the coil.

2 Claims, 1 Drawing Sheet

INDUCTION HEATER FOR DRUMS

FIELD OF INVENTION

The present invention is concerned with an apparatus for heating, more particularly the invention concerns the heating of drums and their contents.

BACKGROUND OF THE INVENTION

Many industrial and chemical products have a high viscosity at low temperatures, and it is therefore often difficult to handle quantities of such products contained in drums under cold or cool conditions. Furthermore, it is common to store the above-mentioned products outside of manufacturing plant, and although the interior of the plant may be at a temperature sufficient to lower the viscosity of the product, the rate of heat transfer into the drum or other container may be insufficient to warm the contents quickly if the product is needed urgently.

As a consequence, various means for heating drums have been suggested.

In the known prior art, drums and other such containers have been heated by steam coils or jackets or by radiant electrical heating in order that the contents may be handled at a temperature at which the viscosity of the content is lower than the viscosity at the ambient temperature. It has also been suggested that induction heating could be employed as an alternative to radiant and/or steam heating.

It is found that the cost of constructing a robust induction heater is prohibitive. Known induction heaters suffered from inevitable mishandling during use, which resulted in the exposure of, and damage to, the current carrying windings. This is not only dangerous to the user, but also necessitates replacement of the heater.

SUMMARY OF INVENTION

According to one aspect of the present invention there is provided an induction heater comprising a substantially cylindrical jacket adapted to be placed around an article which is to be induction heated, and an induction coil arranged within the jacket, characterized in that protuberances project inwardly from the internal surface of the jacket to keep the article spaced apart from the said surface so as to avoid abrasion of the surface by the article.

By providing the abovementioned inwardly projecting protruberances, it is possible to greatly reduce the abrasion of the inner surface of the article and so prevent exposure of the conducting coils which lie below the said inner surface.

Conveniently the protuberances are axially extending ribs.

Although the magnetic flux through the interior of the coil is substantially uniform near the centre of the coil, there is some variation from the ideal Helmholz field. In the interests of uniform heating the article is thus located by means of the axial protruberances.

Preferably, the protuberances incorporate means to provide a change in the visible colour thereof when worn down.

In order to prevent damage to the coils after extended use, it has been found useful to incorporate a coloured material into the ribs as a layer provided towards the base of each rib. As the rib is worn down towards the inner surface of the jacket, the coloured material becomes exposed and provides an indication that the induction heater should be re-lined. Although it is considered that the most useful coloured material would be relatively hard and therefore not mark the drum, it is also considered that in certain applications the coloured material could be sufficiently soft to leave a visible mark on the drum.

Typically, the induction heater comprises a cylindrical jacket and an induction coil, the jacket comprising a cylindrical former on the outside of which the coil is wound, and an outer cover in the form of a plurality of part-cylindrical segments joined together to cover the outside of the coil.

By employing this form of construction, preferably with two shells forming the outer cover, it is possible to construct an induction heater having a relatively smooth outer surface. This is important in many applications where hygenic conditions are required. Furthermore the multi-part construction aids rebuilding of the heater when the wear limit is reached.

The protuberances may be integral with the cylindrical jacket, or may be secured thereto by glue or some suitable fixing means.

In a particular embodiment the invention consists of an induction heater which comprises a substantially cylindrical jacket adapted to be placed around an article which is to be heated, wherein the jacket includes an induction coil to inductively heat the article, and a plurality of ribs disposed upon the inner surface of the jacket to keep the article spaced apart from the surface to avoid abrasion of the surface by the article, wherein each rib is attached to the surface by an adhesive substance containing carbon-black.

It should be understood that it is possible to heat a drum and contents which are not in themselves electrically conductive, provided that at least one conducting body is disposed within and electrically insulated from the induction coil, whereby when an article is placed in contact with the body and currents are induced within the body, inductive heating of the body results in a transfer of heat to the article.

It is therefore possible to heat articles which are not inherently conductive such as polythene drums or glass containers.

Although the invention has been defined in general terms it should be understood that the most preferable embodiment of the invention resides in an induction heater for drums and/or their contents.

The preferred material for the construction of the heater is a fibre glass/resin composite material, which may be treated with a suitable fire retardant, if not inherently fire retardant.

DESCRIPTION OF DRAWINGS

In order that the invention may be further understood it will be described by way of example and with reference to the accompanying drawings wherein.

DETAILED DESCRIPTION OF PREFERRED EMBODIMENT

Figure 1:
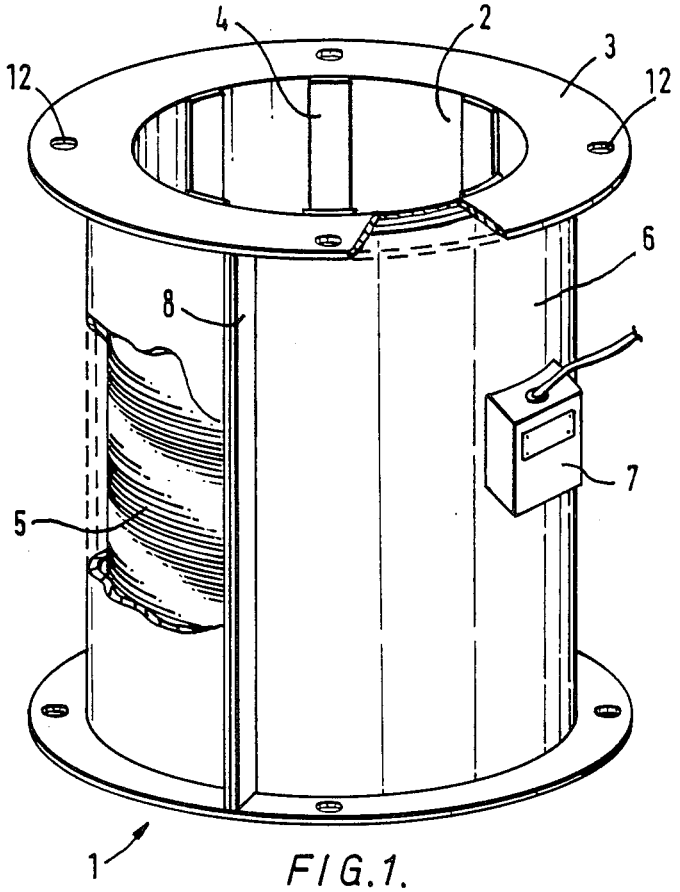
FIG. 1. Shows a section (partially broken) through a drum heater according to the present invention.

Turning to FIG. 1 there is shown an inductive drum heater (1), comprising an inner glass-fibre composite former (2) having flanged ends (3). The inner former (2) is provided with a plurality of inwardly projecting ribs (4) which serve to locate an article within the heater and protect the inner surface of the former (2) from abrasion and damage. The flanged ends (3) are provided with apertures (12) to be used as lifting holes.

A continuous coil of single core 12 swg copper wire (5), is wound onto the outer surface of the former (2), and covered with an outer shell (&6), fitting within the flange (3). In the example illustrated, the outer shell (6) is in two parts and is secured to the former (2). The two parts of the shell are secured together along seams (8). It is prefered that once the coil (5) has been wound onto the inner former, a mixture of fibre-glass resin and catalyst are layered with fibre-glass matting onto the coil.

A connection box (7) is provided on the shell (6) for the supply of current to the coil (5).

Figure 2:
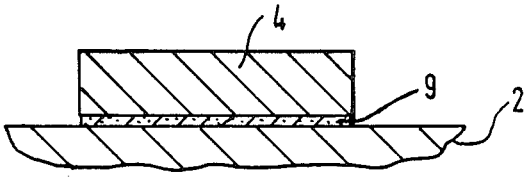
FIG. 2. Shows a detail of the drum heater of figure one, particularly relating to the ribs.

As is shown in more detail in FIG. 2, some or all of the ribs (4), may be provided with a coloured layer (9) at or near to the base of each rib. In the example given the bonding layer employed to secure the ribs to the inner surface of the former includes a coloured additive, more particularly carbon black mixed with the resin component of the fibre-glass. When the ribs are sufficiently worn this layer is exposed giving a visual indication that the ribs (4) need refitting.

It should be understood that the heater can be employed with non-conducting articles provided that a conducting body is brought into contact with the article within the inductive heating field of the coil, such that this body is heated by eddy currents generated by the magnetic flux linkage with the coil.

It is envisaged that the drum heater may be powered directly from the 50Hz mains (240 volts AC), or from a suitable transformer. As it is envisaged that the apparatus will be in the majority of embodiments a class II appliance, it does not generally require a ground.

Various modifications may be made within the scope of the present invention, such as the inclusion into the drum heater of thermostatic control means and/or means to give either a visible or audible indication that the heater is in operation to prevent the exposure of sensitive apparatus to the alternating magnetic fields produced by the coil.

I claim:

1. An induction heater assembly adapted for heating a substantially cylindrical metal drum, comprising a substantially cylindrical, substantially thermally and electrically non- conductive non-metallic double-walled jacket having a central axis and including an inner and an outer member each member having an internal surface and an external surface said external surface of said inner member and said internal surface of said outer member defining an annular substantially cylindrical coaxial space therebetween, an induction coil coaxially arranged within the substantially cylindrical space between the internal and external surfaces of said outer and inner members, respectively, water-proof non-conductive means embedding the induction coil within said substantially cylindrical space, said internal surface of said inner member being configured to receive a metal drum to be heated, a plurality of spaced, axially-extending, inwardly-directed ribs are provided on said internal surface of said inner member for maintaining the metal drum to be heated spaced apart from said internal surface of said inner member to avoid abrasion of the latter by said internal metal drum, each of said plurality of ribs being provided with an embedded layer which becomes visible when the rib is sufficiently worn down to expose the said layer, and said jacket being constructed of materials such that, when the induction coil is energized with AC current while a metal drum is positioned within the jacket, the major heat transfer is to the metal drum by inducion causing it to be raised to an elevated temperature.

2. An induction heater assembly as recited in claim 1 wherein the embedded layer comprises carbon black, and means are provided to mount the plurality of ribs on the jacket internal surface.

* * * * *